US008038506B2

(12) United States Patent
Allen et al.

(10) Patent No.: US 8,038,506 B2
(45) Date of Patent: Oct. 18, 2011

(54) BRASSIERE WITH IMPROVED SIDE PANEL CONSTRUCTION

(75) Inventors: Donald R. Allen, Wantage, NJ (US); Patricia E. McLaurin, Bayonne, NJ (US)

(73) Assignee: Warnaco U.S., Inc., Milford, CT (US)

( * ) Notice: Subject to any disclaimer, the term of this patent is extended or adjusted under 35 U.S.C. 154(b) by 434 days.

(21) Appl. No.: 12/328,008

(22) Filed: Dec. 4, 2008

(65) Prior Publication Data

US 2010/0144242 A1 Jun. 10, 2010

(51) Int. Cl.
*A41C 3/00* (2006.01)

(52) U.S. Cl. ..... 450/92; 450/74; 450/75

(58) Field of Classification Search ..... 450/65, 450/66, 74–76, 39, 58, 59, 92, 93, 1; 2/243.1, 2/1, 69, 275; 66/171, 176, 177, 172 A, 175, 66/196, 197

See application file for complete search history.

(56) References Cited

U.S. PATENT DOCUMENTS 6,645,040 B2 * 11/2003 Rabinowicz et al. ..... 450/1
6,860,789 B2 * 3/2005 Bell et al. ..... 450/20
7,144,294 B2 * 12/2006 Bell et al. ..... 450/20
7,407,427 B2 * 8/2008 Liu ..... 450/39
7,549,971 B2 * 6/2009 Bell et al. ..... 602/75
7,682,219 B2 * 3/2010 Falla ..... 450/92
2006/0105673 A1 * 5/2006 Lau ..... 450/39
2006/0105674 A1 * 5/2006 Lau ..... 450/39
2006/0281389 A1 * 12/2006 Liu ..... 450/1
2008/0280529 A1 * 11/2008 Simpson ..... 450/30
2008/0280530 A1 * 11/2008 Simpson ..... 450/39
2008/0280533 A1 * 11/2008 Simpson ..... 450/39
2008/0280535 A1 * 11/2008 Simpson ..... 450/70
2009/0061732 A1 * 3/2009 Simpson ..... 450/41

* cited by examiner

*Primary Examiner* — Gloria Hale
(74) *Attorney, Agent, or Firm* — Katten Muchin Rosenman LLP

(57) ABSTRACT

A brassiere having flexibility, durability, and improved comfort for the wearer is provided. The side panel of the bra comprises a folded fabric and two elastic bands. The folded fabric has two opposing longitudinal edges, a top edge, and a bottom edge. Each of the two elastic bands is positioned in the interior of the folded fabric along a respective longitudinal edge, which also includes notches for orienting the bands. The folded fabric is sewn together at each of the top and bottom edges such that the two elastic bands are held in place. One of the longitudinal edges may be formed by sewing the folded fabric together to form a seam using a pull-out stitch. Each of the two elastic bands may include either of a woven elastic band or a knitted elastic band.

20 Claims, 10 Drawing Sheets

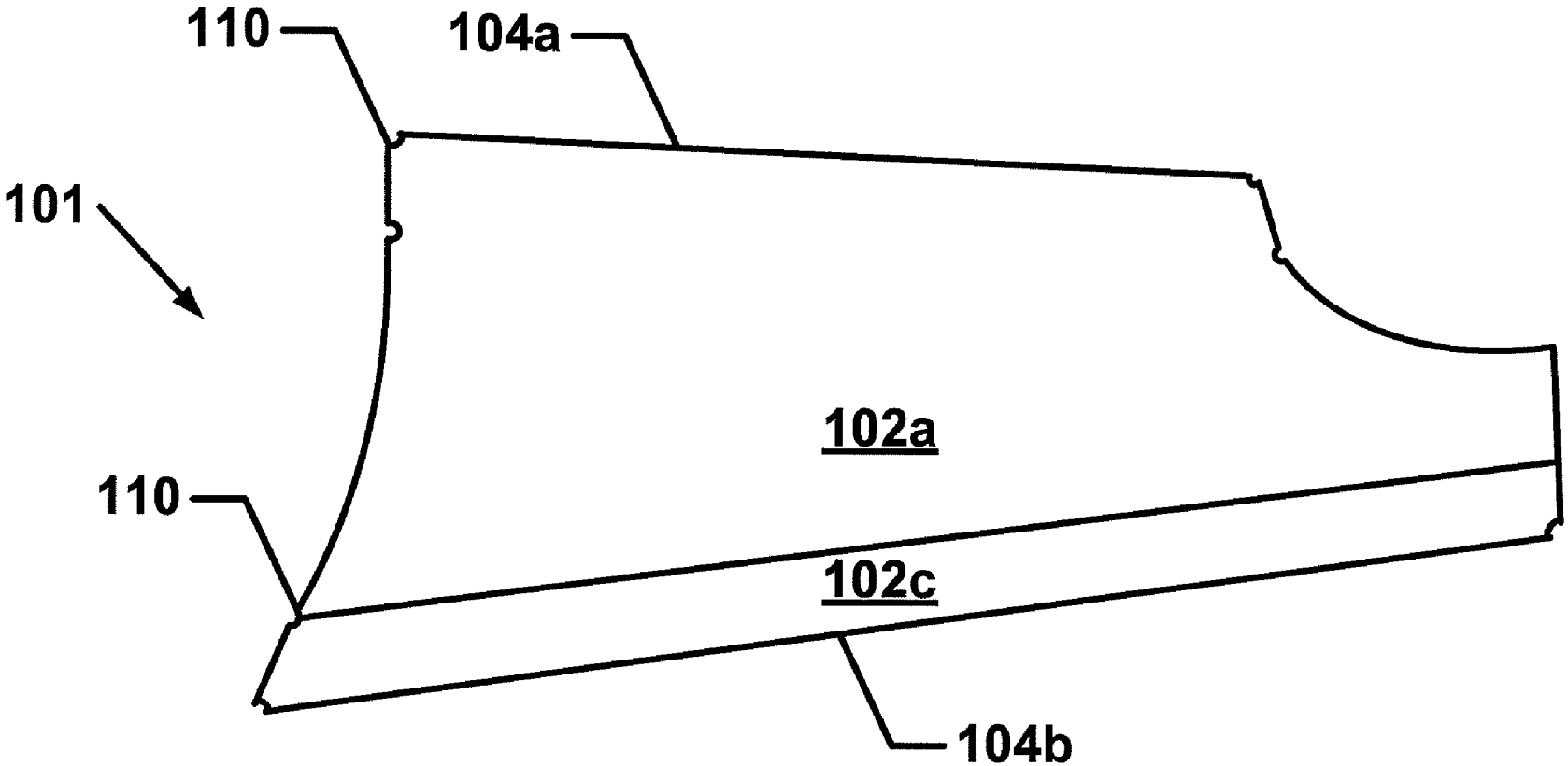
FIGG. 5b

BRASSIERE WITH IMPROVED SIDE PANEL CONSTRUCTION

BACKGROUND OF THE INVENTION

1. Field of the Invention

The present invention relates generally to a brassiere ("bra"). More particularly, the present invention relates to a bra that is especially designed to counteract aspects that typically cause physical discomfort to the wearer.

2. Description of the Related Art

A feature of conventional bras that is common for the wearer to experience discomfort in relation to the side panel construction. An elastic band has traditionally been added to the side panels, also known as the wings or wing portions, of a bra in order to enhance the elasticity of the side panel. This may assist in providing improved sizing characteristics of the bra and provide some degree of flexibility in the side panel size. For example, a wearer need not adjust the size of the chest band if the wearer increases or decreases in chest or bust size as the size change can, to a certain extent, be compensated for by the elastic band.

An elastic band may be sewn onto and along the length of the external side of the fabric layer facing/touching the wearer's skin when the bra is worn. The elastic band may be wrapped or covered by a fabric layer to form an assembly before being sewn onto the side panel.

The main disadvantage of this type of side panel construction is that the elastic band or the assembly may cause discomfort to the wearer and create a visually unappealing appearance. This may increase localized friction on the skin of the wearer. The side panel may also dig into the wearer. Other parts of the side panel that do not include the elastic band may hence bulge out.

In some bras, designated elastic bands are not added to the side panels. The elasticity of the chest bands in such case is provided only by the natural elasticity of the fabric layers of the side panels or in combination with the natural elasticity of any foam layers added to the side panels. The main disadvantage of this type of construction is that the elasticity of the side panels may deteriorate after repeated washing of the bra or repeated or prolonged stretching of the side panels. This may be as a result of the properties of the materials used for making the fabric layers and any foam layers of the side panels.

It is therefore an object of the present invention to provide a brassiere that has improved side panel construction and/or a side panel for association with components to define a brassiere with improved side panel construction.

SUMMARY OF THE INVENTION

In one aspect, the invention provides a brassiere ("bra"). The bra has a pair of breast cups, a left side panel, a right side panel, and a back connecting portion. Each of the left and right side panels has a top longitudinal edge, a bottom longitudinal edge, a front-side edge and a back-side edge. The front-side edge of the left side panel is sewn together with a left portion of the pair of breast cups. The front-side edge of the right side panel is sewn together with a right portion of the pair of breast cups. The back connecting portion is sewn together with each of the respective back-side edges of the left and right side panels. The right side panel is formed using a single fabric by: folding the fabric such that two edges of the fabric meet along one of the longitudinal edges; sewing the two edges together to form a seam such that the fabric comprises in a tubular shape; reversing the fabric so that the first face is facing outward; flattening the fabric so that the seam substantially coincides with a first longitudinal edge; inserting a pattern into the fabric; cutting the fabric according to the inserted pattern; inserting a first elastic band into the fabric along the first longitudinal edge; inserting a second elastic band into the fabric along a second longitudinal edge; sewing together a top edge of the fabric such that a first respective portion of each of the first and second elastic bands is held in place; and sewing together a bottom edge of the fabric such that a second respective portion of each of the first and second elastic bands is held in place.

Preferably, the left side panel may be formed using a second fabric by: folding the second fabric such that two edges of the second fabric meet along one of the longitudinal edges; sewing the two edges together to form a seam such that the fabric comprises in a tubular shape; reversing the second fabric so that the first face is facing outward; flattening the second fabric so that the seam substantially coincides with a first longitudinal edge; inserting a pattern into the second fabric; cutting the second fabric according to the inserted pattern; inserting a third elastic band into the second fabric along the first longitudinal edge; inserting a fourth elastic band into the second fabric along a second longitudinal edge; sewing together a top edge of the second fabric such that a first respective portion of each of the third and fourth elastic bands is held in place; and sewing together a bottom edge of the second fabric such that a second respective portion of each of the third and fourth elastic bands is held in place.

Sewing the two edges together to form a seam may further include using a pull-out stitch. The pattern may include a plurality of notches. Inserting the first elastic band may further include orienting the first elastic band based on respective positions of the plurality of notches. Inserting the second elastic band may further include orienting the second elastic band based on respective positions of the plurality of notches.

Sewing together a top edge of the fabric may further include using a single needle stitch. Sewing together a bottom edge of the fabric may further include using a single needle stitch. Each of the first and second elastic bands may include either of a woven elastic band or a knitted elastic band.

In another aspect, the invention provides a side panel for a brassiere. The side panel comprises a folded fabric and two elastic bands. The folded fabric has two opposing longitudinal edges, a top edge, and a bottom edge. Each of the two elastic bands is positioned in the interior of the folded fabric along a respective longitudinal edge. The folded fabric is sewn together at each of the top and bottom edges such that the two elastic bands are held in place. One of the longitudinal edges may be formed by sewing the folded fabric together to form a seam using a pull-out stitch.

The side panel may further include a plurality of notches. Each of the two elastic bands may be oriented based on respective positions of the plurality of notches. The folded fabric may be sewn together at each of the top and bottom edges using a single needle stitch. Each of the two elastic bands may include either of a woven elastic band or a knitted elastic band.

In yet another aspect, the invention provides a method for constructing a brassiere ("bra"). The bra has two breast cups, a left side panel, a right side panel, and a back connecting portion. Each of the left and right side panels comprises a fabric having a first face and a second face. The method comprises the steps of: constructing the right side panel; constructing the left side panel; and sewing together the breast cups, the right side panel, the left side panel, and the back connecting portion to form the bra. The step of constructing the right side panel comprises the steps of: folding the fabric so that the second face is facing outward and that two edges of the fabric meet; sewing the two edges together to form a seam such that the fabric comprises in a tubular shape; reversing the fabric so that the first face is facing outward; flattening the fabric so that the seam substantially coincides with a first longitudinal edge; inserting a pattern into the fabric; cutting the fabric according to the inserted pattern; inserting a first elastic band into the fabric along the first longitudinal edge; inserting a second elastic band into the fabric along a second longitudinal edge; sewing together a top edge of the fabric such that a first respective portion of each of the first and second elastic bands is held in place; and sewing together a bottom edge of the fabric such that a second respective portion of each of the first and second elastic bands is held in place.

Preferably, the step of constructing the left side panel may comprise the steps of: folding a second fabric so that the second face is facing outward and that two edges of the second fabric meet; sewing the two edges together to form a seam such that the second fabric comprises in a tubular shape; reversing the second fabric so that the first face is facing outward; flattening the second fabric so that the seam substantially coincides with a first longitudinal edge; inserting a pattern into the second fabric; cutting the second fabric according to the inserted pattern; inserting a third elastic band into the second fabric along the first longitudinal edge; inserting a fourth elastic band into the second fabric along a second longitudinal edge; sewing together a top edge of the second fabric such that a first respective portion of each of the third and fourth elastic bands is held in place; and sewing together a bottom edge of the second fabric such that a second respective portion of each of the third and fourth elastic bands is held in place.

The step of sewing the two edges together to form a seam may further include using a pull-out stitch. The pattern may include a plurality of notches. The step of inserting the first elastic band may further include orienting the first elastic band based on respective positions of the plurality of notches. The step of inserting the second elastic band may further include orienting the second elastic band based on respective positions of the plurality of notches.

The step of sewing together a top edge of the fabric may further include using a single needle stitch. The step of sewing together a bottom edge of the fabric may further include using a single needle stitch. Each of the first and second elastic bands may include either of a woven elastic band or a knitted elastic band.

BRIEF DESCRIPTION OF THE DRAWINGS

FIG. 5*b* illustrates the pattern of FIG. 5*a* in a folded state.

DETAILED DESCRIPTION OF THE INVENTION

Figure 1:
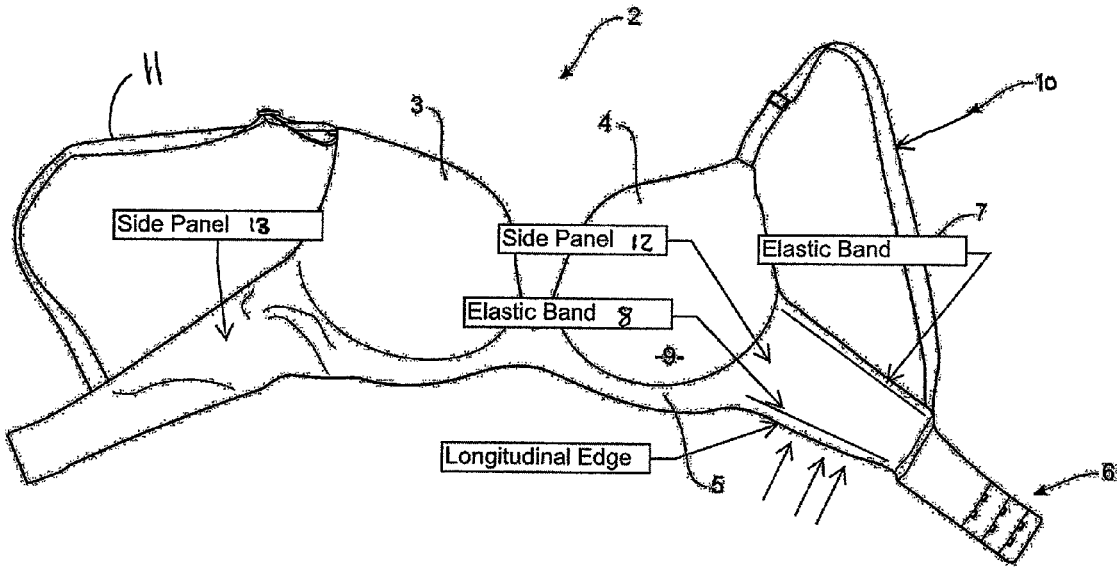
FIG. 1 illustrates a brassiere according to a preferred embodiment of the invention.

Referring to FIG. 1, in accordance with a preferred embodiment of the present invention, there is shown a bra 2 that may generally be defined by breast cups 3 and 4, shoulder straps 10 and 11, side panels 12 and 13, and back connecting portion 6. Side panel 12 includes elastic bands 7 and 8 along respective longitudinal edges, including longitudinal edge 5.

Such over the shoulder straps may however be optional as it is envisaged that the bra may also be of a strapless version. Indeed, while reference is herein made to a bra, it is envisaged that the assembly of panels component parts and items to define such, may alternatively be incorporated into other garments such as, for example, evening dresses or bathing suits or similar.

At the ends of each of the back connecting portions 6 may be fasteners that are mutually cooperative to allow for the bra to be fastened about the chest of a wearer.

The bra may be seamless and made from materials at least some of which are molded or moldable and that are engaged to each other preferably at least in part by lamination.

As can be seen with reference to FIG. 1, the breast cups 3, 4 may be secured to the side panels 12, 13 and the shoulder straps 10, 11. In addition or in the alternative to should straps 10, 11 that are secured to bra 2, an attachment means comprising a hook (not shown) and a catch 10*a* that is secured to side panel 12, e.g., side panel 13, via a fabric reinforcement 10*b* as shown for example, in FIG. 3*e*.

Such securing of the breast cup may occur by adhesive and/or ultrasonic welding or other forms of welding and/or by stitching.

Bra 2 may be any kind of bra, one having underwires, no wires, having a longitudinal edge under the cups or not.

An object of the present invention is to provide a side panel for a bra that enables the wearer to feel more comfortable wearing the bra as compared with conventional bras. Accordingly, with reference to FIGS. 2, 3*a*-3*d*, and 4, a side panel 12 of a bra comprises minimal stitching.

Figure 3A:
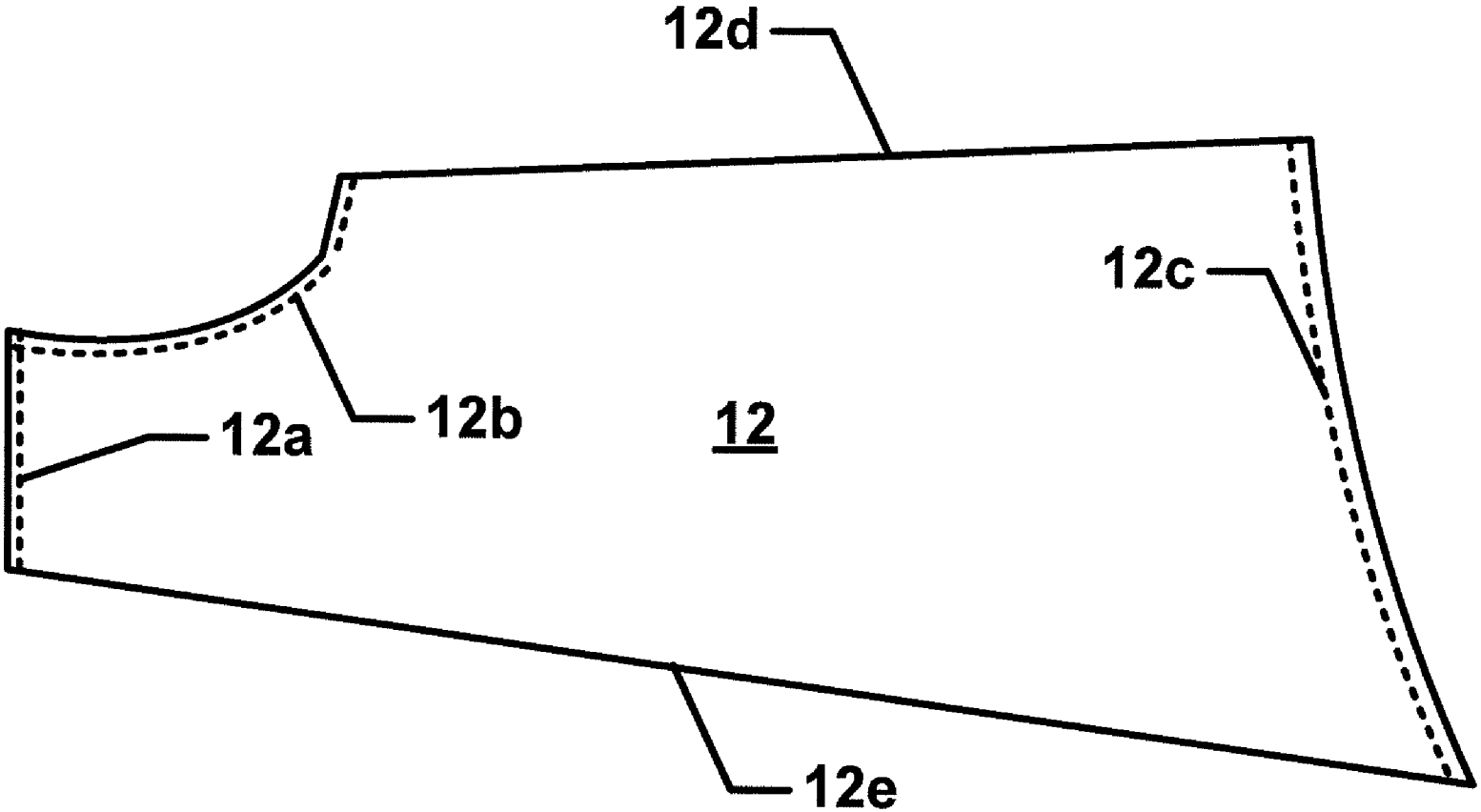
FIG. 3*a* is a schematic view of an obverse side of a side panel of a brassiere according to a preferred embodiment of the invention.
Figure 3B:
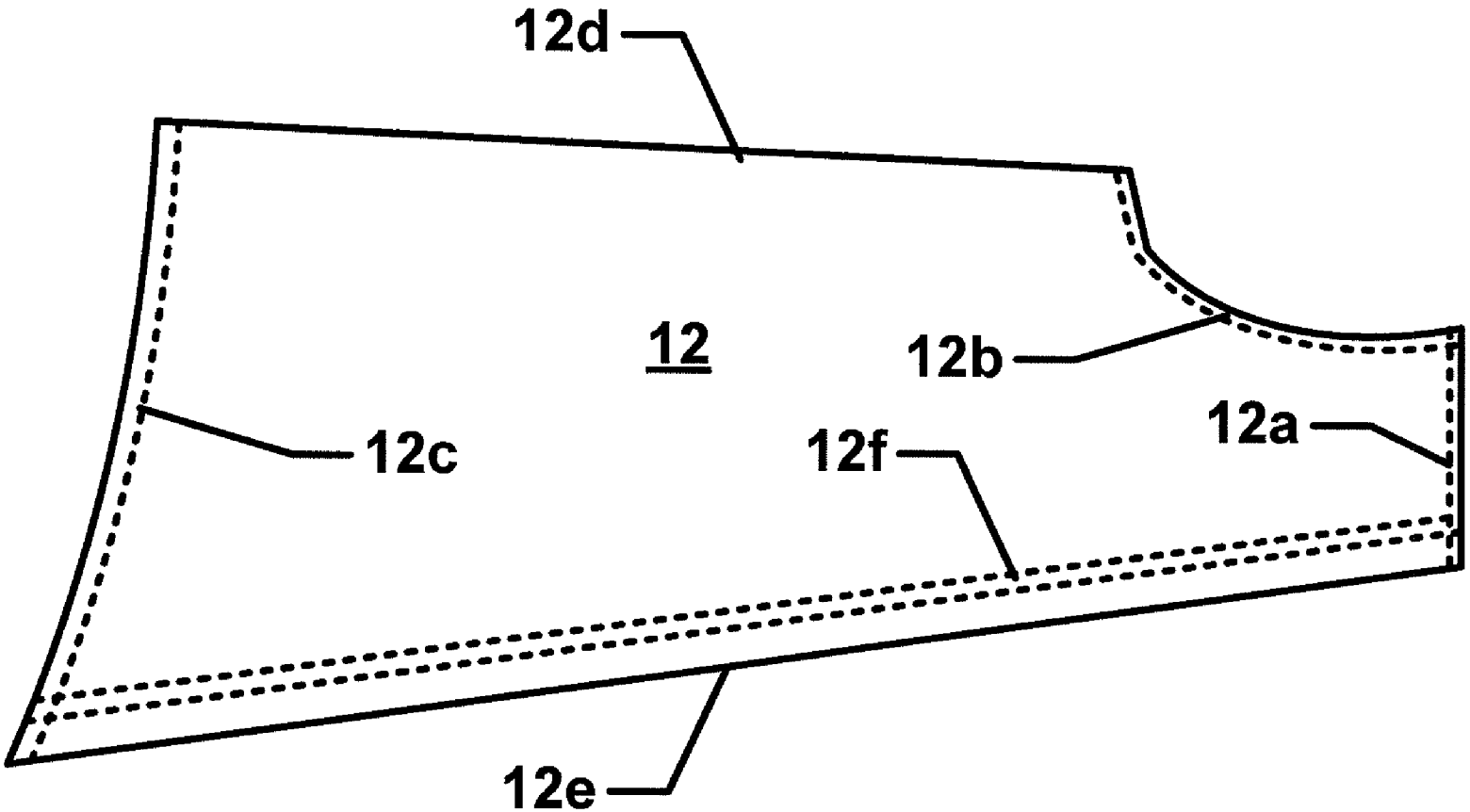
FIG. 3*b* is a schematic of a reverse side of the side panel of FIG. 3*a*.
Figure 3C:
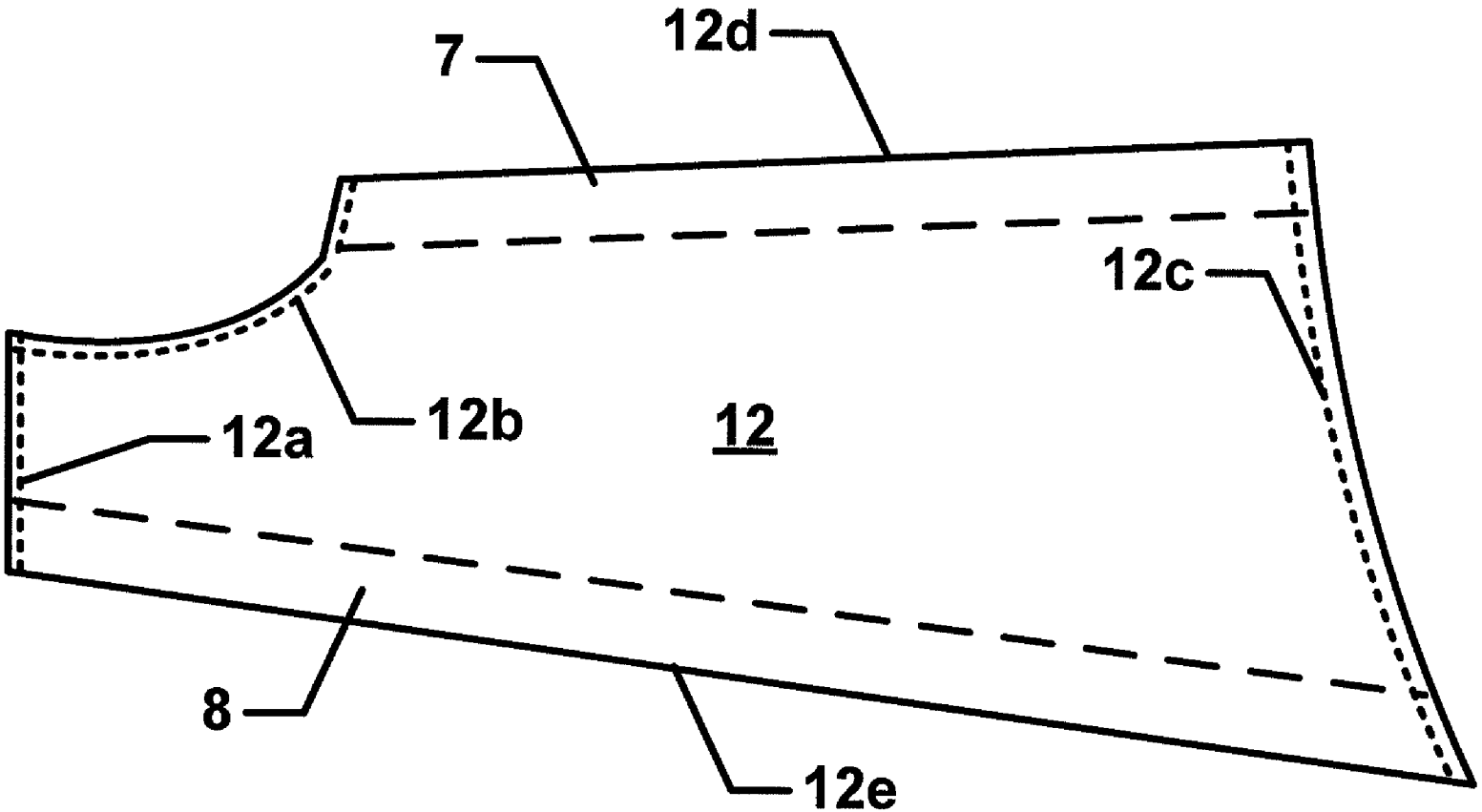
FIG. 3*c* is a schematic view of the side panel of FIG. 3*a*, wherein elastic bands that are inside the side panel are indicated.
Figure 3D:
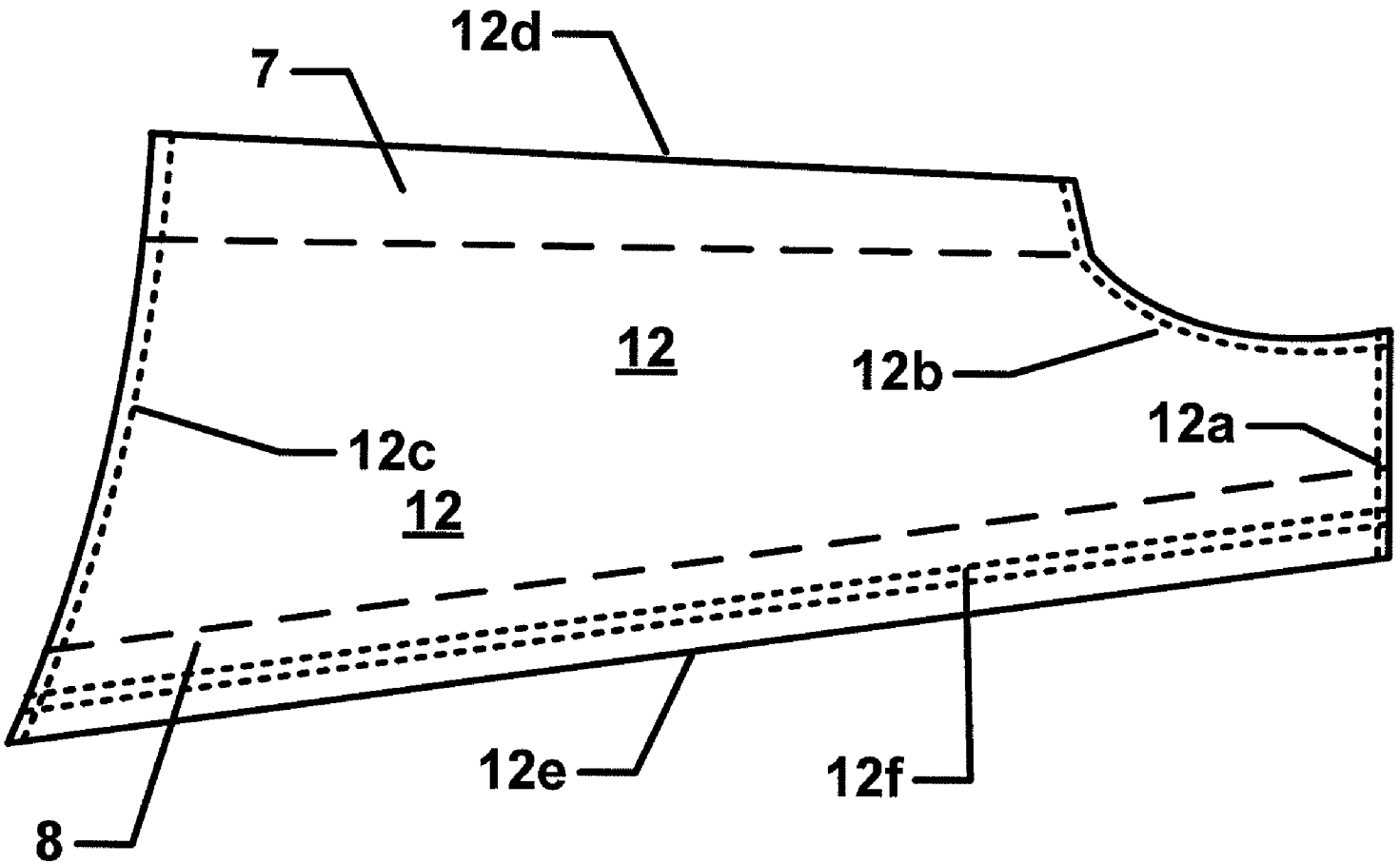
FIG. 3*d* is a schematic view of the side panel of FIG. 3*b*, wherein elastic bands that are inside the side panel are indicated.
Figure 3E:
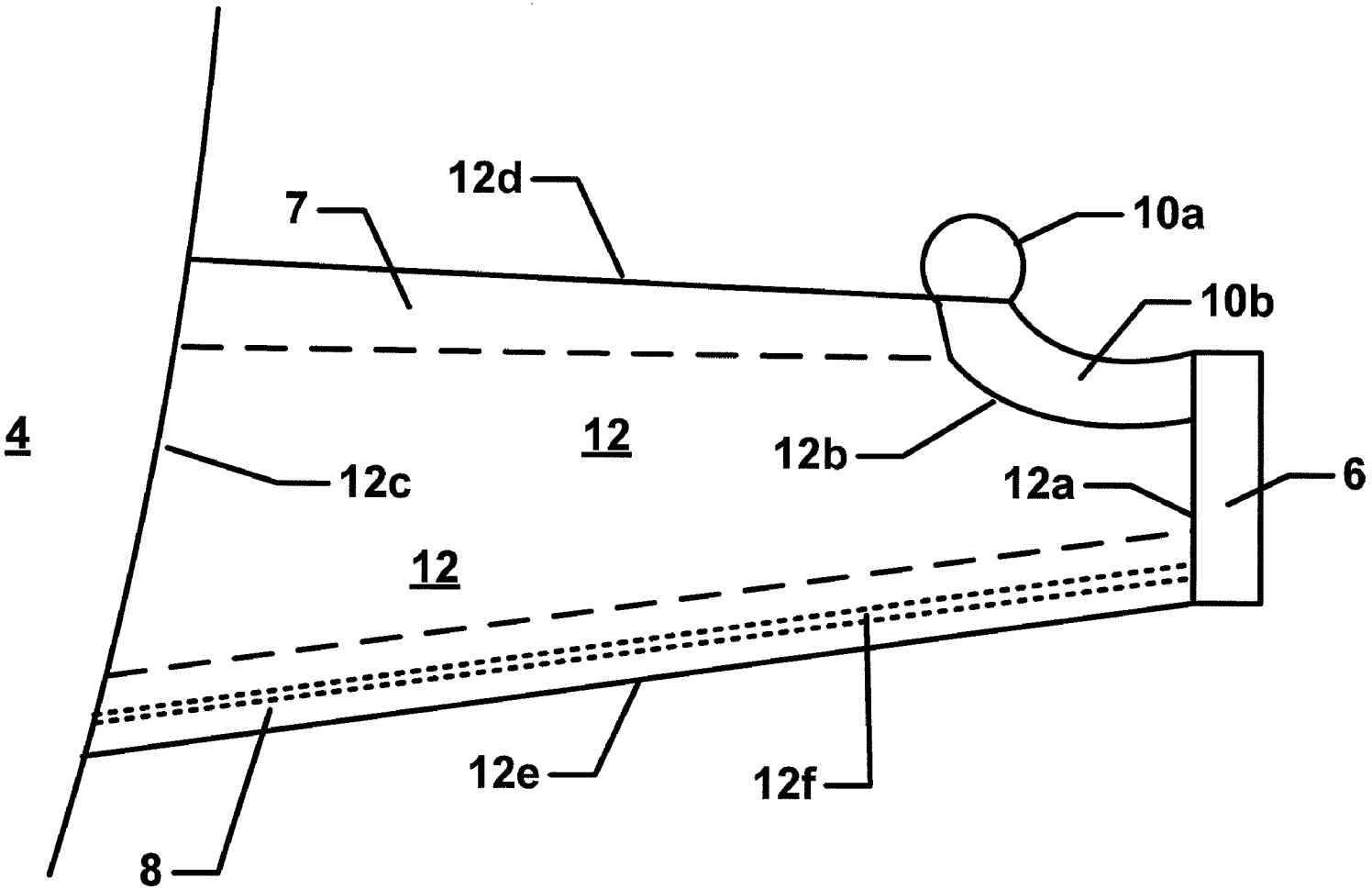
FIG. 3*e* is a schematic view of the side panel of FIG. 3*b* mounted in a portion of a bra, which is different from that shown in FIG. 1.
Figure 4:
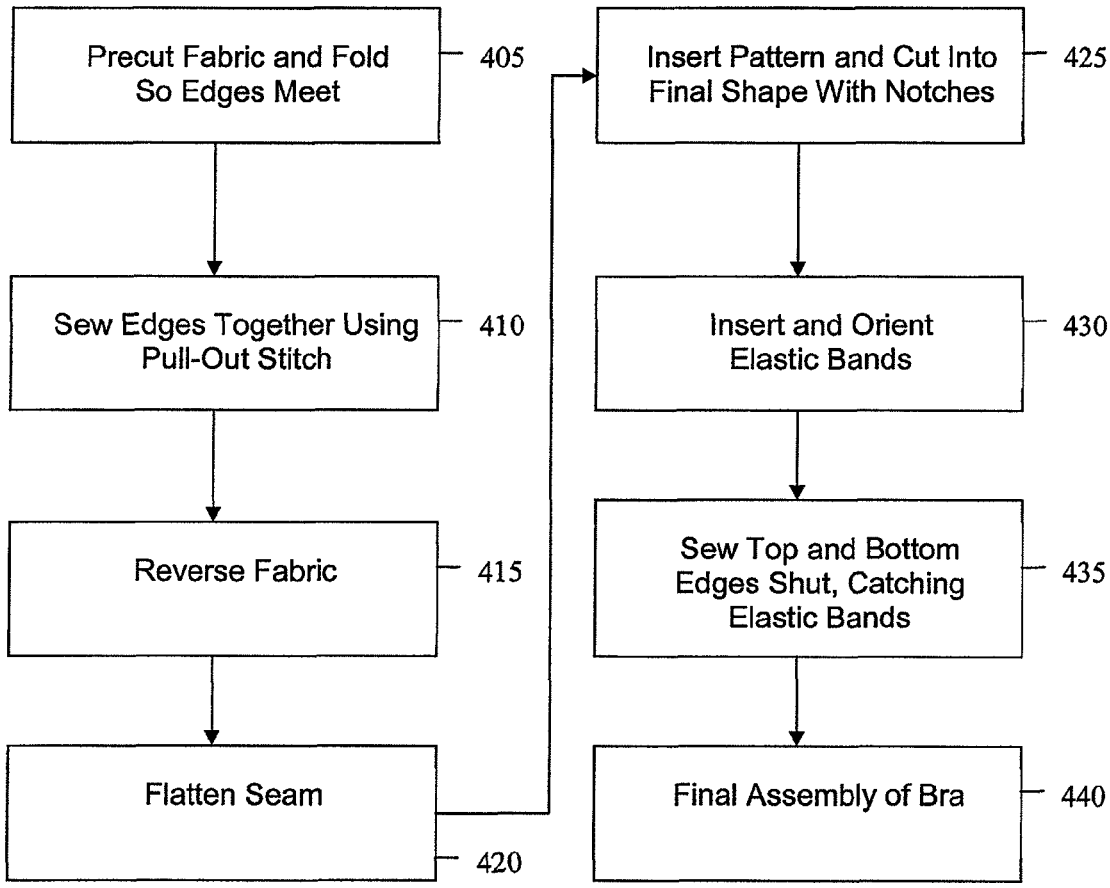
FIG. 4 illustrates a flow chart for a process of constructing a side panel of the brassiere according to a preferred embodiment of the invention.

Therein, as seen in FIG. 3*a*, the obverse of side panel 12 includes only edge stitching 12*a*, 12*b*, and 12*c* to which respectively abut a portion of the closure 6, a bra strap 7 or bras strap attachment means 10*a*, 10*b*, or bra cup 3. In contrast, peripheral edges 12*d* and 12*e* do not include stitching and are configured as folded over fabric. The shape of the edges 12*d* and 12*e* is maintained by the elastic bands 7 and 8, respectively, as can be seen in FIG. 3*c*. As seen in FIG. 3*b*, the reverse side includes a longitudinal stitching 12*f* as and edge stitch 12*a*-12*c*.

Figure 2:
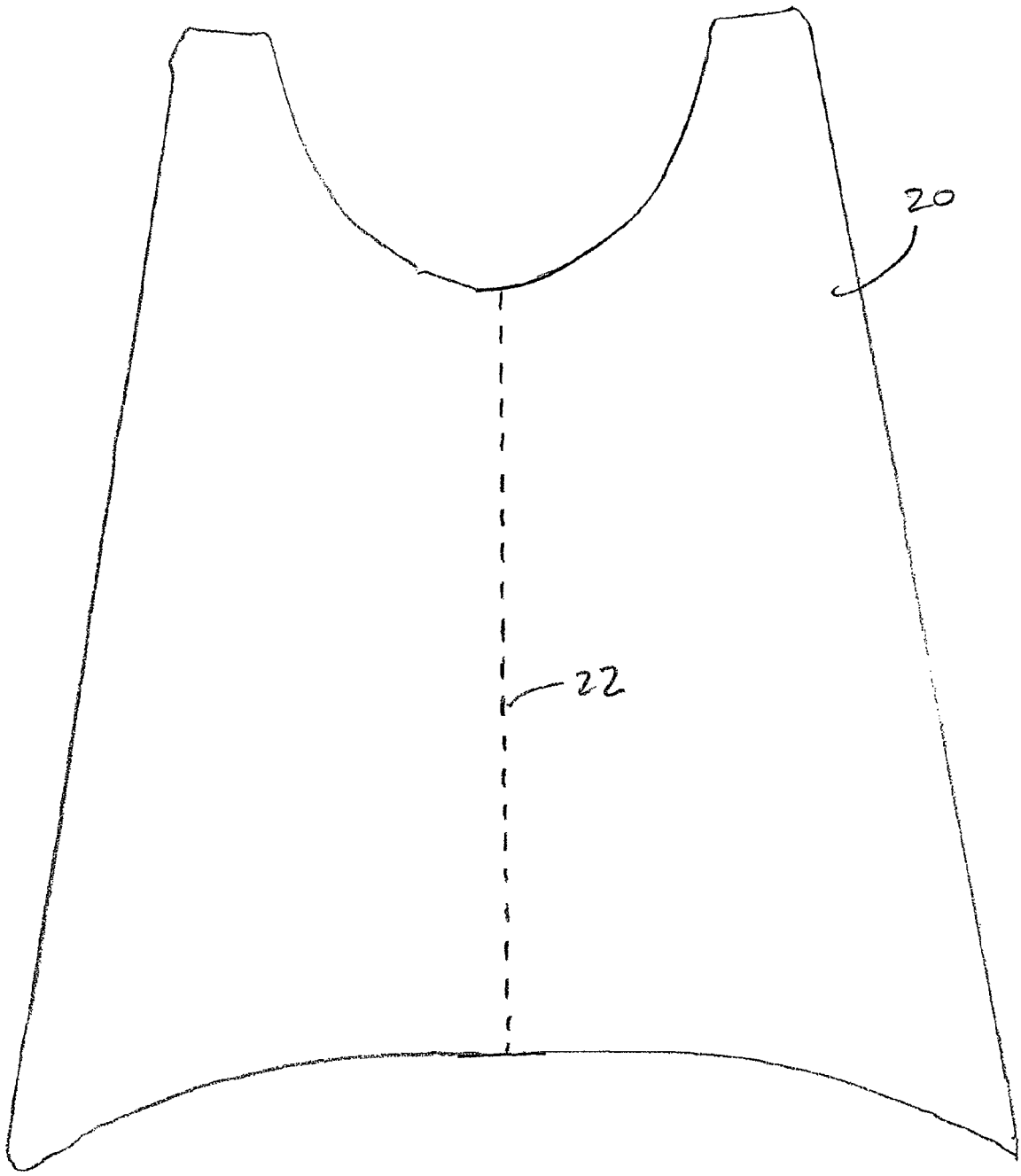
FIG. 2 illustrates a fabric to be used to form a side panel of a brassiere according to a preferred embodiment of the invention.

Side panel 12, e.g., side panel 13, is constructed by executing the following steps:

In the first step 405, using a single piece of fabric (not shown), the fabric is precut into a preferred shape and then folded so that the edges meet. Referring to FIG. 2, a fabric 20 is folded along dotted line 22 such that the left-side edge meets the right-side edge.

In the second step 410, the left-side edge and right-side edge are sewn with stitching 12*f*, preferably using a pull-out stitch, thereby forming a seam. In this manner, the fabric has a tubular structure with unsewn openings at the top and bottom edges.

In the third step 415, the fabric is reversed such that the interior of the tubular structure is turned to the exterior and the exterior of the tubular structure is turned to the interior.

In the fourth step 420, the seam is flattened to reduce irritation to the skin of the wearer.

Figure 5A:
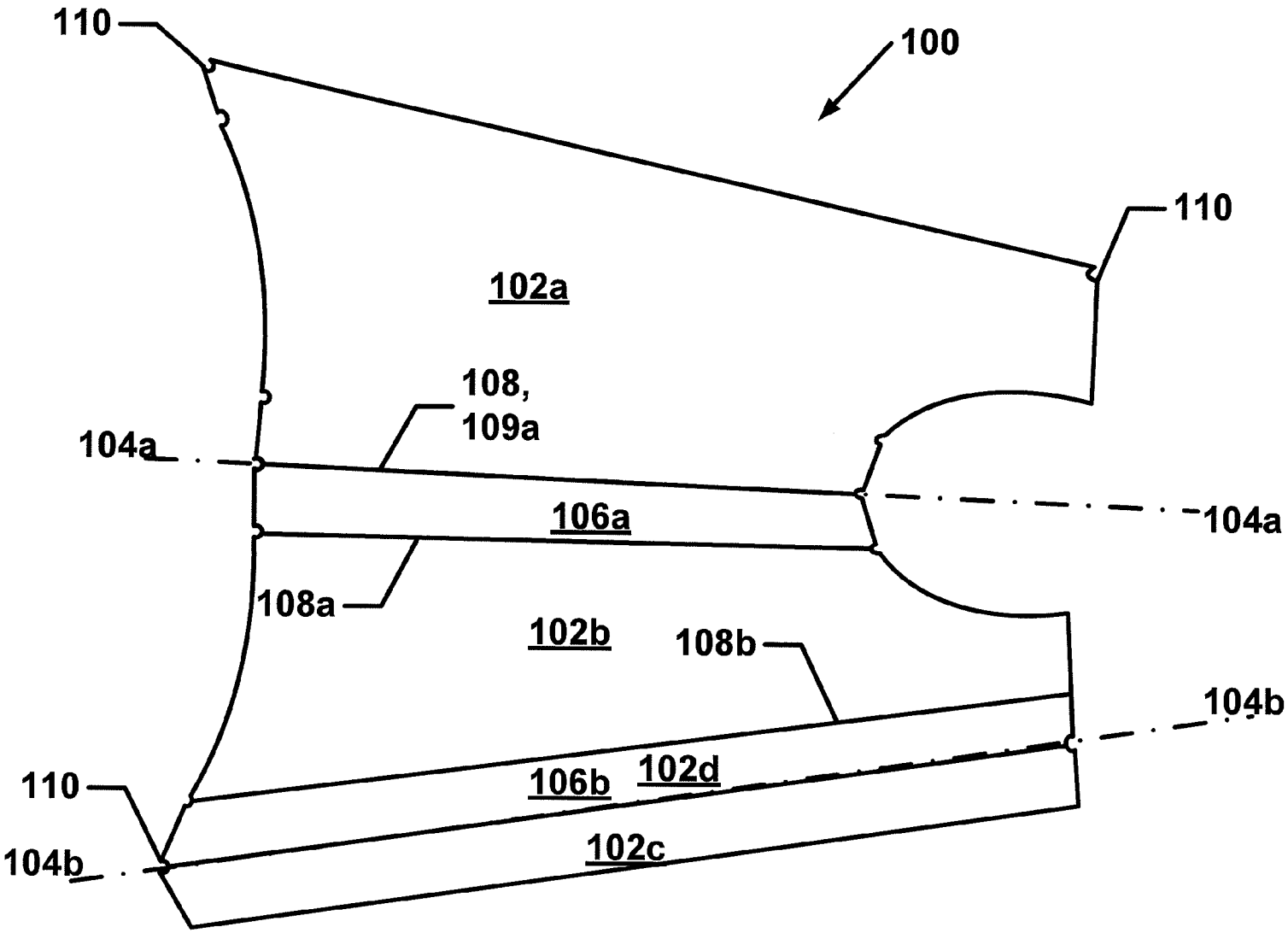
FIG. 5*a* illustrates a pattern fully flattened used in the process of constructing a side panel of the brassiere according to a preferred embodiment of the invention.

In the fifth step 425, a pattern 100 is used in folded position 101, which is illustrated in FIG. 5*b*, and then the fabric is cut along the pattern into the final shape of the side panel 12.

Pattern 100 includes periphery 101 that when folded comprises a shape of side panel 12, e.g., side panel 13. Panel 100 comprises a first area 102*a* and a second area 102*b* that are substantially symmetrical about an axis 104*a*. Pattern 100 includes a third area 102*c* and is substantially symmetrical about an axis 104*b* with a subarea 102*d*, which is a portion of area 102*b*.

Pattern 100 further includes area 106*a* defined between a fold line comprised along axis 104*a* and fold lines and/or embossed lines 108*a* and area 106*b* defined between a fold line comprised along axis 104*b* and folded and/or embossed line 108*b*. Therein, a plurality of notches 110 are present in the pattern.

Pattern 100 is then folded over along fold lines, e.g., axis. 104*a* and 104*b* to form a folded pattern shape 101 wherein area 102*a* is directly opposite area 102*b* and area 102*c* is opposite area 102*d*.

Therein in step 425, the fabric is cut such that edges of the fabric include notches that correspond to one or more notches 110 in the pattern.

In the sixth step 430, broad elastic bands 7, 8 are inserted into the fabric so that they are positioned along the two longitudinal edges of the side panel 12 and being positioned into the folded over pattern such that they are located in areas 106*a* and 106*b*, respectively. Notches 110 are used to orient the elastic bands and secure the elastic bands via stitching.

In alternative, the elastic bands are placed in areas 106*a* and 106*b* when the pattern is open. When the pattern is folded over, the elastic bands are retained via embossed or folded lines 108*a*, 108*b*.

The pattern in a folded state and including the elastic bands is then inserted into the tube structure of fabric.

In the seventh step 435, side edges of the fabric are sewn shut, preferably using a single needle stitch, and forming edge stitching 12*a*, 12*b*, and 12*c*. In sewing these edges shut via edge stitching 12*a*, 12*b*, 12*c*, the elastic bands 7, 8 are sewn together with the fabric, thereby holding the elastic bands in place.

Lastly, in step 440, in a final assembly, the side panel 12 is sewn together with the bra cups, and a back-connecting portion is sewn together on the distal end of the side panel 12.

The base fabric for the side panel 12 preferably includes a two-way stretch fabric that has excellent recovery properties, often referred to as bounce-back property. Preferably, a traditional stitched design is used, although a fused design is also possible. In this manner, a side panel 12 may be constructed to have flexibility, durability, and maximum comfort to the wearer. In addition, the procedure described above and in FIG. 4 is intended to minimize the number of seams. This is enabled by using a pull-out stitch, which is accomplished by folding the top back edge and then joining the bottom raw edges with an open merrow machine. In addition, the inside facing elastic is "free floating," which permits unrestricted movement of the fabric.

The elastic bands 7, 8 may be made from a knitted elastic or a woven elastic. Preferably, the width of each elastic band may be within the range of 8-25 millimeters, and more preferably, the width is selected from the following exemplary widths: 10 millimeters, 13 millimeters, 16 millimeters, 18 millimeters, 19 millimeters, 22 millimeters, and 25 millimeters.

While the foregoing detailed description has described particular preferred embodiments of this invention, it is to be understood that the above description is illustrative only and not limiting of the disclosed invention. While preferred embodiments of the present invention have been shown and described herein, it will be obvious to those skilled in the art that such embodiments are provided by way of example only. Numerous variations, changes, and substitutions will now occur to those skilled in the art without departing from the invention.

What is claimed is:

1. A brassiere with improved side panel construction comprises:

a pair of breast cups, a left side panel, a right side panel, and a back connecting portion, each of the left and right side panels having a top longitudinal edge, a bottom longitudinal edge, a front-side edge and a back-side edge, wherein the front-side edge of the left side panel is sewn together with a left portion of the pair of breast cups, the front-side edge of the right side panel is sewn together with a right portion of the pair of breast cups, and the back connecting portion is sewn together with each of the respective back-side edges of the left and right side panels, and wherein the right side panel is formed using a single piece of fabric by folding the fabric such that two edges of the fabric meet along one of the longitudinal edges;

sewing the two opposite edges together to form a seam such that the fabric comprises in a tubular shape;

reversing the fabric so that the first face is facing outward;

flattening the fabric so that the seam substantially coincides with a first longitudinal edge;

inserting a pattern in the form of a bra side panel tubular portion into the fabric;

cutting the fabric according to the inserted pattern;

inserting a first elastic band into the fabric along the first longitudinal edge;

inserting a second elastic band into the fabric along a second longitudinal edge;

sewing together a top edge of the fabric such that a first respective portion of each of the first and second elastic bands is held in place; and sewing together a bottom edge of the fabric such that a second respective portion of each of the first and second elastic bands is held in place.

2. The brassiere of claim 1, wherein the left side panel is formed using a second fabric by folding the second fabric such that two edges of the second fabric meet along one of the longitudinal edges;

sewing the two edges together to form a seam such that the fabric comprises a tubular shape;

reversing the second fabric so that the first face is facing outward;

flattening the second fabric so that the seam substantially coincides with a first longitudinal edge;

inserting a pattern into the second fabric tubular portion;

cutting the second fabric according to the inserted pattern;

inserting a third elastic band into the second fabric along the first longitudinal edge;

inserting a fourth elastic band into the second fabric along a second longitudinal edge;

sewing together a top edge of the second fabric such that a first respective portion of each of the third and fourth elastic bands is held in place; and sewing together a bottom edge of the second fabric such that a second respective portion of each of the third and fourth elastic bands is held in place.

3. The brassiere of claim 1, wherein sewing the two edges together to form a seam further comprises using a pull-out stitch.

4. The brassiere of claim 1, wherein the pattern includes a plurality of notches, and wherein inserting the first elastic band further comprises orienting the first elastic band based on respective positions of the plurality of notches, and wherein inserting the second elastic band further comprises orienting the second elastic band based on respective positions of the plurality of notches.

5. The brassiere of claim 1, wherein sewing together a top edge of the fabric further comprises using a single needle stitch, and wherein sewing together a bottom edge of the fabric further comprises using a single needle stitch.

6. The brassiere of claim 1, wherein each of the first and second elastic bands comprises a woven elastic band.

7. The brassiere of claim 1, wherein each of the first and second elastic bands comprises a knitted elastic band.

8. A side panel for a brassiere, the side panel comprising:

a folded fabric portion and two elastic bands, the folded fabric portion having two opposing longitudinal edges, a top edge, and a bottom edge, wherein each of the two elastic bands is positioned in the interior of the folded fabric portion along a respective longitudinal edge, and wherein the folded fabric portion is sewn together at each of the top and bottom edges such that the two elastic bands are held in place.

9. The side panel for a brassiere of claim 8, wherein one of the longitudinal edges is formed by sewing the folded fabric portion together to form a seam using a pull-out stitch.

10. The side panel for a brassiere of claim 8, further comprising a plurality of notches, and wherein each of the two elastic bands is oriented based on respective positions of the plurality of notches.

11. The side panel for a brassiere of claim 8, wherein the folded fabric portion is sewn together at each of the top and bottom edges using a single needle stitch.

12. The side panel for a brassiere of claim 8, wherein each of the two elastic bands comprises a woven elastic band.

13. The side panel for a brassiere of claim 8, wherein each of the two elastic bands comprises a knitted elastic band.

14. A method for constructing a brassiere with improved side panel construction, the brassiere comprising two breast cups, a left side panel, a right side panel, and a back connecting portion, each of the left and right side panels comprising a fabric portion having a first face and a second face, the method comprising the steps of:

constructing the right side panel;

constructing the left side panel; and sewing together the breast cups, the right side panel, the left side panel, and the back connecting portion to form the brassiere, wherein the step of constructing the right side panel comprises the steps of folding the fabric portion so that the second face is facing outward and that two edges of the fabric meet;

sewing the two edges together to form a seam such that the fabric portion comprises in a tubular shape;

reversing the fabric portion so that the first face is facing outward;

flattening the fabric portion so that the seam substantially coincides with a first longitudinal edge;

inserting a pattern into the fabric portion;

cutting the fabric portion according to the inserted pattern;

inserting a first elastic band into the fabric portion along the first longitudinal edge;

inserting a second elastic band into the fabric portion along a second longitudinal edge;

sewing together a top edge of the fabric portion such that a first respective portion of each of the first and second elastic bands is held in place; and sewing together a bottom edge of the fabric portion such that a second respective portion of each of the first and second elastic bands is held in place.

15. The method of claim 14, wherein the step of constructing the left side panel comprises the steps of:

folding a second fabric portion so that the second face is facing outward and that two edges of the second fabric portion meet;

sewing the two edges together to form a seam such that the second fabric portion comprises in a tubular shape;

reversing the second fabric portion so that the first face is facing outward;

flattening the second fabric portion so that the seam substantially coincides with a first longitudinal edge;

inserting a pattern into the second fabric portion;

cutting the second fabric portion according to the inserted pattern;

inserting a third elastic band into the second fabric portion along the first longitudinal edge;

inserting a fourth elastic band into the second fabric portion along a second longitudinal edge;

sewing together a top edge of the second fabric portion such that a first respective portion of each of the third and fourth elastic bands is held in place; and sewing together a bottom edge of the second fabric portion such that a second respective portion of each of the third and fourth elastic bands is held in place.

16. The method of claim 14, wherein the step of sewing the two edges together to form a seam further comprises using a pull-out stitch.

17. The method of claim 14, wherein the pattern includes a plurality of notches, and wherein the step of inserting the first elastic band further comprises orienting the first elastic band based on respective positions of the plurality of notches, and wherein the step of inserting the second elastic band further comprises orienting the second elastic band based on respective positions of the plurality of notches.

18. The method of claim 14, wherein the step of sewing together a top edge of the fabric portion further comprises using a single needle stitch, and wherein the step of sewing together a bottom edge of the fabric further comprises using a single needle stitch.

19. The method of claim 14, wherein each of the first and second elastic bands comprises a woven elastic band.

20. The method of claim 14, wherein each of the first and second elastic bands comprises a knitted elastic band.

* * * * *